US006207033B1

(12) United States Patent
Miller et al.

(10) Patent No.: US 6,207,033 B1
(45) Date of Patent: Mar. 27, 2001

(54) PROCESS AND APPARATUS FOR REGENERATION OF CHROMIUM PLATING BATH

(75) Inventors: Mark D. Miller, Rensselaer; Joseph F. Cox, Schenectady; Steven Langston, Latham, all of NY (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/306,289

(22) Filed: May 6, 1999

(51) Int. Cl.[7] ..... C25D 21/18

(52) U.S. Cl. ..... 205/101; 205/283; 205/742; 205/759; 204/DIG. 13; 204/252

(58) Field of Search ..... 205/101, 283, 205/742, 759; 204/DIG. 13, 252

(56) References Cited

U.S. PATENT DOCUMENTS 3,616,304 * 10/1971 Bedi et al. ..... 204/252
4,118,295 * 10/1978 Korenowski et al. ..... 205/746

* cited by examiner

*Primary Examiner*—Arun S. Phasge
(74) *Attorney, Agent, or Firm*—John F. Moran; Michael C. Sachs; Robert C. Beam

(57) ABSTRACT

A process for the regeneration of a plating bath comprising trivalent chromium involves the use of platinum anode and a copper cathode wherein the anode to cathode ratio is greater than 2:1 upon passage of a charge having a current density of at least 10 Amperes/diameter$^2$ of exposed cathode. An apparatus for conducting the process is also disclosed. The described process obviates the need for an ion exchange resin and is conducted without the formation of any deleterious toxic sludge.

14 Claims, 2 Drawing Sheets

PROCESS AND APPARATUS FOR REGENERATION OF CHROMIUM PLATING BATH

STATEMENT OF GOVERNMENT INTEREST

The United States of America has certain rights and licenses in this invention.

FIELD OF THE INVENTION

The present invention relates to a chromium plating bath. More specifically, the present invention relates to a process and apparatus for the regeneration of a plating bath comprising trivalent chromium.

BACKGROUND OF THE INVENTION

The electroplating of chromium is a well known concept which has been employed with varying degrees of success for the past several decades. The earliest processes for effecting this end involved the use of hexavalent chromium salts which yielded excellent wear resistance and proved to be suitable in numerous applications. However, workers in the art soon discovered that chromium plating with hexavalent chromium often and repeatedly led to the need to maintain high concentrations of chromium metal in solution.

Typically, such processes involve the use of approximately 250 g/l of hexavalent chromium and with the passage of plating time the trivalent chromium concentration increases to a level which has proven to be unsatisfactory for continued chromium plating. At that juncture, the failure to reduce the trivalent chromium concentration will result in deposits of poor quality.

Heretofore, the conventional method for the regeneration of a spent chromium plating bath having an unacceptable level of trivalent chromium involves the use cationic exchange resins wherein the spent chromium plating bath undergoes oxidation of trivalent chromium to hexavalent chromium. A common and cumbersome technique for effecting this end involves the use of a suitable tank which is used to form a reservoir of spent chromium plating solution. Anode assemblies are supported on the tank within the reservoir. Each of the anode assemblies includes two frame sections bolted together along their sides and bottom with separate cation selective membranes being secured between them. Membrane tensioners are then inserted between the membranes to separate them and urge them against the frame sections over openings therein to define an anode chamber. A suitable anode and cathode is then provided to generate a current flow therebetween which oxidizes the trivalent chromium in the depleted chromium solution in the anode chamber to form hexavalent chromium. The resultant solution has a lesser density than the depleted chromium solution and rises above the depleted chromium solution in the anode chamber. Then, regenerated solution is then drained from the top of the anode chamber and recycled for further use.

Still another technique for effecting this end, commonly referred to as the "Pfaudler Electrolytic Purification (EP) Cell" involves the use of ceramic cells to effect regeneration of the chromic acid solution which is circulated continuously through the EP cell from the plating tank. The EP chosen comprises cylindrical, unglazed ceramic cells holding a cathode and an electrolyte disposed intermediate a pair of external anodes. The electrodes chosen are typically lead which requires regular cleansing. The size of the tank chosen for this process and the number of cells required is determined by the size of the tank and the level of contamination to be removed.

Unfortunately, each of these prior art processes for regenerating chromium plating baths has been found unsatisfactory due to the fact that both processes result in the formation of a concentrated chromium sludge at the bottom of the process tank, such sludge containing a high hexavalent chromium content which must be treated and disposed of as a hazardous waste. This process is economically nonfeasible since the hexavalent chromium ion is an environmental toxin and carcinogen.

Furthermore, ion exchange technique has a limited lifetime and can only be used a few times prior to replacement, another limiting economic factor. Membrane filters in the ion exchange resin frequently become contaminated with chromic acid and require frequent scrubbing, an extremely burdensome and hazardous operation which exposes workers in the art top toxic hexavalent chromium. Accordingly, the replacement of spent ion exchange resin columns adds still further economic burdens to the process. Accordingly, efforts to develop new and economically attractive techniques for effecting this end have been continuously pursued by workers in the art.

SUMMARY OF THE INVENTION

In accordance with the present invention this end has successfully been attained by means of a novel technique wherein a spent chromic acid plating bath is regenerated by having its trivalent chromium concentration lowered without the need of an ion exchange resin and absent the formation of any deleterious toxic sludge at the base of the regeneration tank. Furthermore, the novel technique does not require the use of membranes, thereby obviating the need for either cleansing or replacement thereof.

Briefly, this end is attained by using a system having a platinum anode and a copper cathode wherein the anode to cathode ratio is greater than 2:1 with a general preference existing for a ratio ranging from 8:1 to 15:1. In the operation of the process, trivalent chromium is oxidized to hexavalent chromium upon passage of a charge having a suitable current density which may range from as low as 10 Amperes/diameter2 to a preferred value of about 100 Amperes/diameter$^2$ of exposed cathode through the regeneration cell which results in the lowering of the trivalent chromium concentration without causing the formation of any toxic sludge requiring disposal. Although current densities less than 100 Amperes/diameter$^2$ have been found functional in the regeneration process, studies have revealed that they are less than optimal.

BRIEF DESCRIPTION OF THE DRAWING

The invention will be more readily understood by reference to the following detailed description taken in conjunction with the accompanying drawing wherein.

DETAILED DESCRIPTION OF THE INVENTION

Figure 1:
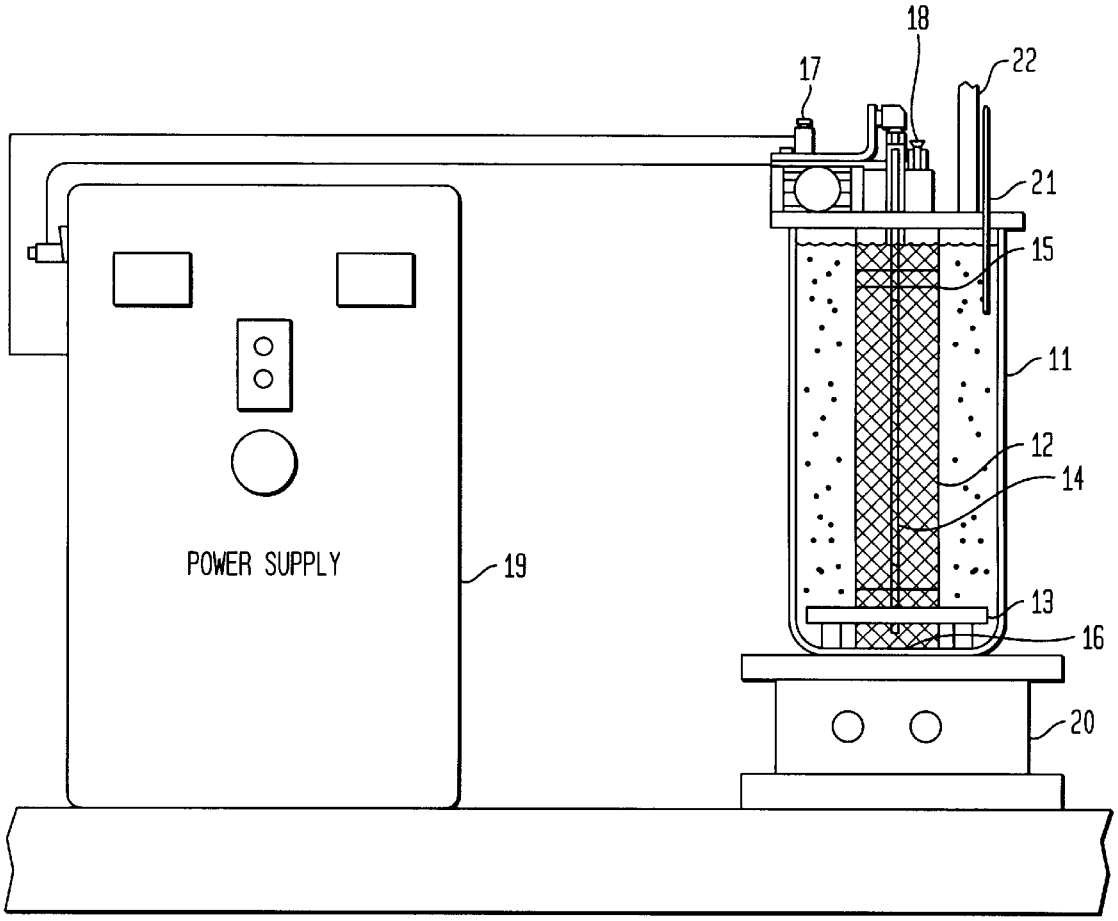
FIG. 1 is a front elevational view in schematic form of a apparatus suitable for use in the practice of the present invention.

With reference now more particularly to FIG. 1 there is shown an apparatus suitable for use herein. Shown in the figure is a chromic acid holding tank 11 having disposed therein an anode member 12 positioned within centering stand 13, copper cathode member 14, centering rings 15, magnetic stirrer 16 and positive and negative terminal connections 17 and 18, respectively, to the anode and cathode. Also shown is a power supply 19 and a secondary heat source 20 upon which holding tank 11 is positioned. Also shown disposed within tank 11 is temperature probe 21 and ventilation tube 22.

Figure 2:
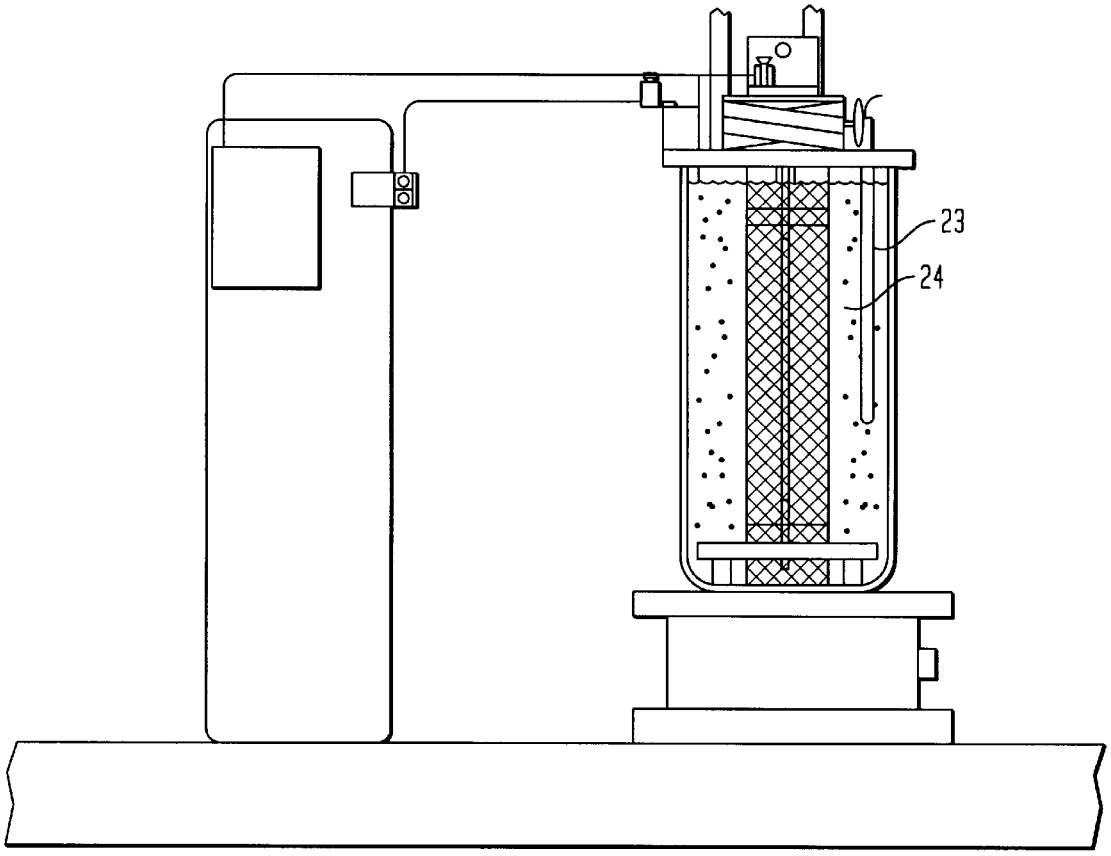
FIG. 2 is a side elevational view of the apparatus of FIG. 1.

Shown in FIG. 2 is the apparatus of FIG. 1 in side view which further reveals the presence of immersion heater 23 disposed within the interior of tank 11.

In the operation of the regeneration system, a chromic acid bath 24 is added to tank 11 which is typically two feet in length and may be comprised of glass or steel having a high temperature thermal liner or high temperature nalgene which is capable of holding the chromic acid to be regenerated. Additionally, the container chosen must be capable of withstanding temperatures as high as 85° C. Disposed within tank 11 is an anode 12 which may either be platinum or a platinum coated titanium anode having a platinum coating of 50 to 100 microns. The anode may be cylindrical mesh for optimal results. However, lower trivalent chromium concentrations are also attainable when the anode is not mesh and/or cylindrical. Other shapes are suitable but with a lesser degree of efficiency, as for example, the use of a square anode. The anode may have a diameter of the order of 5 inches with a wall thickness of the order of 0.0625 inch. It will be appreciated that these dimensions are exemplary only and are not to be construed as limiting. The actual dimensions will be dependent upon the amount of solution to be regenerated and the length of the exposed cathode.

The cathode material chosen for use herein is preferably copper although steel would be considered acceptable. Typical dimensions may be 0.50 inch in diameter with a wall thickness of 0.375 inch and an overall length of about two feet. It will be appreciated that these dimensions are exemplary only and are not to be construed as limiting.

The immersion heater employed in the apparatus serves to heat the chromic acid solution to be regenerated to a temperature within the range of 80 to 85° C. Immersion heater 23 is activated or heated by a proportional control heater, not shown. Glass temperature probe 21 provides control feedback to the control heater which in turn controls immersion heater 23.

Shrink tubing is employed in the apparatus to mask off areas of the cathode which plating is not desired, thereby controlling the anode to cathode ratio during the plating process.

A hot plate stirrer may be used, if desired, as an additional heat source to aid the immersion heater in maintaining a heated regeneration bath and to effect stirring of the chromic acid solution. It will be understood that other types of heating mechanisms may be used rather than the hot plate, for example, steam, immersions heaters and the like. The anode to cathode ratio is considered critical and must be at least 2:1 with a preferred range being from 8:1 to 30:1 and general preference being found for a range of 8:1 to 15:1.

Almost any current source that generates bubbles of hydrogen is suitable for use herein. However, the current density or charge used should be proportional to the time it takes to regenerate the bath. That is, higher current densities reduce the trivalent chromium concentration more rapidly. In other words, the reduction of the trivalent chromium concentration is proportional to the charge that is passed through the regeneration cell. A current density of 100 $A/dm^2$ (as measured against the exposed cathode area) was found to be a preferred value for regenerating the trivalent chromium. Studies have revealed that approximately one-third of the trivalent chromium concentration is removed for every 10 to 20 amp hours per liter of solution that is passed through the regeneration cell.

A jack stand with an adjustable height knob is employed to raise or lower the cathode before and during the plating process.

In addition to the foregoing, all nuts, bolts used in and around the chromium solution are required to be resistant to chromic acid attack and preferably comprise titanium or Teflon. Glass suction condensers or scrubbers are also employed to remove chromium mist and hydrogen generated during the regeneration process, such being important for the safety of workers in the regeneration area.

The described system represents a dramatic departure from the prior art techniques employing ion exchange resins which resulted in the formation of a concentrated and toxic sludge solution containing carcinogens and toxic hexavalent chromium. The instant technique results in a lowering of the trivalent chromium concentration without producing any toxic-like sludge which requires disposal, so resulting in an economic saving in the hundreds of thousands of dollars.

In the operation of the regeneration process, chromium plating occurs at the cathode which may be reused as required. The overall concentration of $Cr^{+6}$ (hexavalent chromium or $CrO^3$) does not change in significant amounts. This occurs because much of the $Cr^{+6}$ that is lost due to plating chromium metal onto the cathode is replenished by the oxidation of $Cr^{+3}$ to $Cr^{+6}$.

The system is normally operated until the desired trivalent chromium concentration is attained. The anode is rinsed with water when regeneration is completed and it is available for reuse.

The cathode is normally removed upon completion of the regeneration process and the system turned off. The cathode need merely be rinsed with water and is then available for reuse.

While the invention has been described in detail in the foregoing specification, it will be understood by those skilled in the art that variations may be made by those skilled in the art without departing from the spirit and scope of the invention.

What is claimed is:

1. Process for the regeneration of a plating bath including trivalent chromium cations, the process comprising a single plating tank forming a continuum fully containing the plating bath having disposed therein both a platinum containing anode and a cathode, the anode to cathode ratio being greater than 2:1, the process further comprises the steps of heating the plating bath to a temperature within the range of 80–85° C. and applying a charge having a current density of at least 10 $A/dm^2$ of exposed cathode to plate chromium on the cathode while the anode in the plating bath oxidates the trivalent chromium cations to hexavalent chromium.

2. Process in accordance with claim 1 wherein the anode is pure platinum.

3. Process inn accordance with claim 1 wherein the anode comprises platinum coated titanium.

4. Process in accordance with claim 1 wherein the cathode 2 comprises copper.

5. Process in accordance with claim 1 wherein the cathode 2 comprises steel.

6. Process in accordance with claim 1 wherein the anode to cathode ratio is in the range of 8:1 to 30:1.

7. Process in accordance with claim 6 wherein the anode to cathode ratio is 8:1 to 15:1.

8. Process in accordance with claim 7 wherein the current 2 density is 100 $A/dm^2$.

9. Process in accordance with claim 7 wherein the anode is a cylindrical mesh platinum covered titanium anode.

10. Apparatus for the regeneration of a plating bath containing trivalent chromium cations, the plating bath fully included in a single tank having disposed therein both a platinum anode and a copper cathode, the platinum anode oxidizes the trivalent chromium cations to hexavalent chromium while the copper cathode is plated with chromium in the plating bath of the single tank, the ratio of anode to cathode being greater than 2:1, means for heating said plating bath, and means for applying a current to said bath having a density of at least 10 $A/dm^2$.

11. Apparatus in accordance with claim 10 including a platinum coated titanium anode having a platinum coating of 50–100 microns.

12. Apparatus in accordance with claim 11 wherein the anode to cathode ratio is within the range of 8:1 to 15:1.

13. Apparatus in accordance with claim 11 wherein the anode is a titanium anode having a platinum coating of 50 microns.

14. Apparatus in accordance with claim 10 wherein the anode to cathode ratio is within the range of 8:1 to 30:1.

* * * * *